United States Patent [19]

Turcotte et al.

[11] 4,403,774

[45] Sep. 13, 1983

[54] DEVICE FOR OBTAINING READINGS OF STATISTICAL VARIABLES

[76] Inventors: Roger Turcotte, 4094 Harvard, Montreal, Quebec, Canada, H4A 2W7; Vincent Papillon, 5236 Durocher, Outremont, Quebec, Canada, H2V 3Y1

[21] Appl. No.: 277,861

[22] Filed: Jun. 26, 1981

[51] Int. Cl.[3] ..... A63F 5/04

[52] U.S. Cl. ..... 273/143 R; 273/142 R

[58] Field of Search ..... 273/142 R, 142 A, 142 B, 273/142 C, 142 D, 142 E, 142 F, 142 G, 142 H, 142 HA, 142 J, 142 JA, 142 JB, 142 JC, 142 JD, 142 K, 143 R, 143 A, 143 B, 143 C, 143 D, 143 E, 138 R, 138 A; 40/306, 5, 10 R, 19, 111, 113, 114, 115; 434/206, 402

[56] References Cited

U.S. PATENT DOCUMENTS

| | | | |
|---|---|---|---|
| 1,353,491 | 9/1920 | Patterson | 273/143 R |
| 1,578,445 | 3/1926 | Koegle | 273/142 R X |
| 1,970,586 | 8/1934 | Wahlberg | 273/142 R |
| 2,502,190 | 3/1950 | Wassell | 40/10 R |
| 2,655,738 | 10/1953 | Shapiro et al. | 273/142 R X |
| 3,870,313 | 3/1975 | Rowman | 273/143 C |
| 3,945,644 | 3/1976 | Ortiz | 273/143 D |
| 3,949,986 | 4/1976 | Breslow | 273/143 R X |
| 4,066,264 | 1/1978 | Rowman | 273/143 R |

FOREIGN PATENT DOCUMENTS

| | | | |
|---|---|---|---|
| 857292 | 11/1952 | Fed. Rep. of Germany | 273/143 R |
| 494531 | 5/1954 | Italy | 273/143 R |

*Primary Examiner*—Richard C. Pinkham
*Assistant Examiner*—Arnold W. Kramer
*Attorney, Agent, or Firm*—Alan Swabey; Robert Mitchell; Guy Houle

[57] ABSTRACT

A device for obtaining readings of statistical variables in a random manner. The device comprises a base member having a bottom wall, a cylindrical side wall extending vertically above the bottom wall, and a vertical centering post projecting from the bottom wall centrally of the cylindrical side wall. A data carrying circular spool, having a circular bottom wall, is centrally supported for rotation on the post. The cylindrical side wall has reference location for obtaining a reading of information from the spool.

8 Claims, 7 Drawing Figures

DEVICE FOR OBTAINING READINGS OF STATISTICAL VARIABLES

BACKGROUND OF THE INVENTION (a) Field of the Invention

Th present invention relates to a device for obtaining readings of statistical variables in a random manner.

There exists a need to provide a simple portable mechanical device capable of containing statistical data information and to be operated manually to obtain readings from the statistical information in a random manner.

SUMMARY OF THE INVENTION

It is a feature of the present invention to provide a device for obtaining readings of statistical variables in a random manner as is required by the above need in the art.

A further feature of the present invention is to provide a device for obtaining readings of statistical variables in a random manner, and which is easy to use and assemble.

Another feature of the present invention is to provide a device for obtaining readings of statistical variables in a random manner and which is hand-portable and economical.

A still further feature of the invention is to provide a device wherein the sampling time between readings is decreased while not affecting the random nature of the sampling.

According to the above features, from a broad aspect, the present invention provides a device for obtaining readings of statistical variables in a random manner. The device comprises a base member having a bottom wall, a cylindrical side wall extending vertically above the bottom wall, and a vertical centering post projecting from the bottom wall centrally of the cylindrical side wall. A data carrying circular spool, having a circular bottom wall, is centrally supported for rotation on the post. The cylindrical side wall has reference means for obtaining a reading of information from the spool.

BRIEF DESCRIPTION OF THE DRAWINGS

A preferred embodiment of the present invention will now be described with reference to the example thereof illustrated in the accompanying drawings, in which.

DESCRIPTION OF PREFERRED EMBODIMENTS

Figure 1:
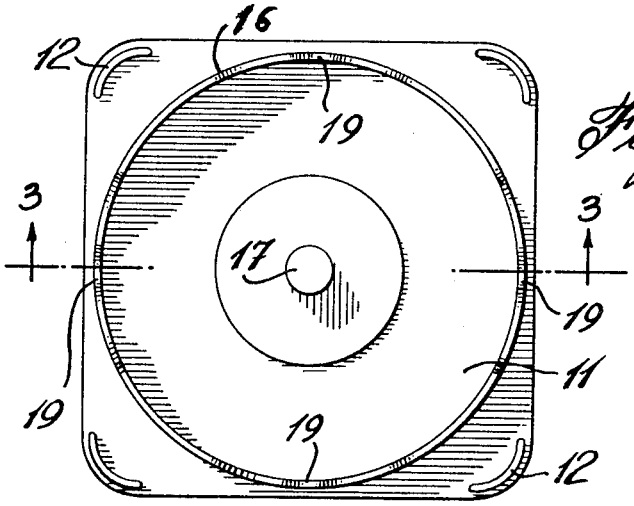
FIG. 1 is a top plan view of the base member of the device of the present invention.
Figure 2:
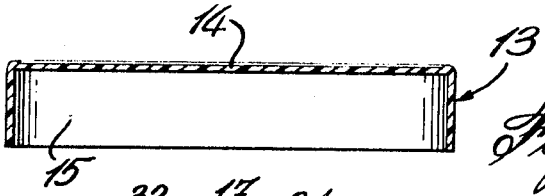
FIG. 2 is a sectional view of the cover which fits over the base member.

Referring now to the drawings and more particularly to FIG. 1, there is shown the base member 10 herein comprised by a bottom wall 11 of a generally rectangular configuration and having locating corner ribs 12 to locate the cover 13 of FIG. 2 thereover. The cover 13 is constituted by a top wall 14 and a peripheral wall 15.

As shown in FIG. 1, a cylindrical side wall 16 extends vertically above the bottom wall 11. A vertical centering post 17 projects centrally from a concentric elevated flat portion 31 on the bottom wall 11.

Figure 5:
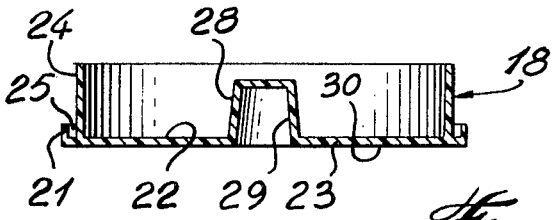
FIG. 5 is a diametrical section view of the data carrying spool.
Figure 7:
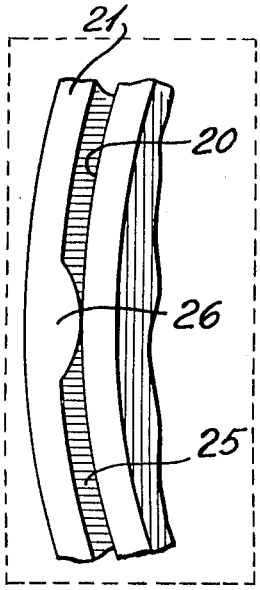
FIG. 7 is an enlarged view of a portion of FIG. 6.

As shown in FIG. 5, a data carrying circular spool 18 is provided for rotational support on the elevated wall portion 31 about the centering post 17. Reference means 19 is provided at four spaced apart symmetrical intervals in the cylindrical side wall 16 of the base member for obtaining readings of data information carried by the spool 18. As seen more clearly in FIGS. 5 to 7, the data spool 18 is provided with a peripheral retention slot 25 for vertical support of a flat data strip 20 about the outer periphery of the spool. The retention slot 25 is constituted by a short vertical peripheral rim 21 extending vertically about the spool above the upper surface 22 of the spool bottom wall 23. A cylindrical vertical back wall 24 is closely spaced inwardly of the rim and extends vertically above the upper surface 22 of the bottom wall 23 whereby to define the retention slot 25 intermediate the peripheral rim 21 and the back wall 24 for the retention of the data strip therein.

Figure 4:
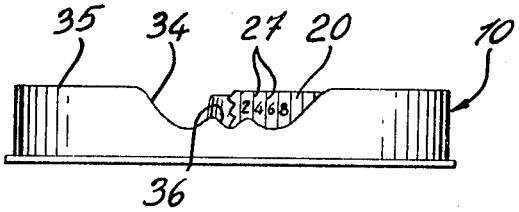
FIG. 4 is an end view of FIG. 1 partly fragmented showing the spool supported by the base member.

The cylindrical retention back wall 24 is higher than the peripheral rim to provide a solid support backing surface for the data strip 20. Also, retention lugs 26 project inwardly of the peripheral rim 21, at spaced apart intervals therealong to provide clamping pressure on the lower edge portions of the data strip positioned in the retention slot 25. As seen in FIG. 4, the data strip 20 is provided with a grid 27 of statistical data.

A central hub 28 is formed with the bottom wall 23 of the spool and extends above the top surface 22 of the spool bottom wall 23. A post receiving cavity 29 extends into the hub from a bottom face 30 of the bottom wall 23 to receive the centering post 17 of the base member 10 therein. The centering post 17 is shorter than the depth of the cavity so that the bottom wall lower surface 30 of the spool will rest on the elevated portion 31 of the base bottom wall 11. The post 17 prevents lateral displacement of the spool when spun thereabout.

Figure 3:
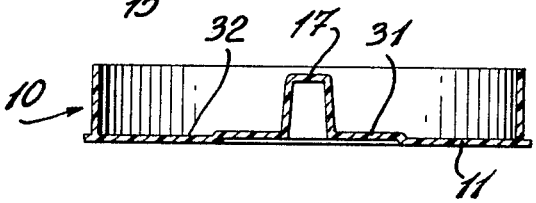
FIG. 3 is a cross-sectional view along section lines 3—3 of FIG. 1.

As seen in FIG. 3 the circular elevated portion 31 in the top surface 32 of the bottom wall 11 frictionally engages a portion of the bottom surface 30 of the spool 18 to constitute a braking surface to arrest the rotation of the spool when the spool bottom surface 30 is in close spacing thereto. The brake reduces the rotation time of the spool about the post 17 and does not affect random sampling.

Figure 6:
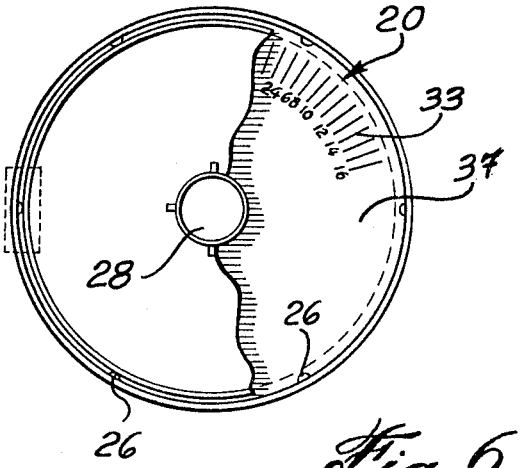
FIG. 6 is a top plan view of the data carrying spool showing a data disc partly fragmented.

As shown in FIG. 6, the upper surface 22 of the spool bottom wall 23 also constitutes a support surface for a flat data disc 37 also provided with a grid 33 of statistical data.

In operation, the spool 18 is positioned on the base member 10 with the cavity 29 of the spool receiving the vertical centering post 17 therein for centering. The central hub 28 of the spool is then grasped between the fingers and given a rotational twist whereby the spool will rotate about the centering post 17. As this spool rotates a cushion of air builds up under the spool bottom wall and elevates the spool therefrom. In order to ensure that there is ample access of air admission to the area between the spool bottom wall and the top wall of the base member, air passages are provided in the cylindrical side wall 16 and herein constituted by two or more symmetric openings 34. The openings extend downward from a top edge 35 of the cylindrical side wall and as shown in FIG. 4 delineate a locating slot 36 which constitutes the reference means 19. This locating slot permits the support of the sharp lead portion of a pencil thereon to guide it against the grid 27 of the data strip 20 to obtain a precise reading of the information on the strip 20 immediately in line with the locating slot. Thus, in the initial stages of rotation of the spool 18, a cushion of air is formed between the bottom wall 23 of the spool and the top surface of the bottom wall 11 whereby the spool is liberated from frictional engagement to provide a displacement which is not repetitive but random whereby a non-repetitive pattern of information may be read off the data strip 20 or the data disc 37 or both.

It is a feature of the present invention to cover any obvious modifications of the example of the preferred embodiment described herein, provided such modifications fall within the scope of the appended claims.

We claim:

1. A device for obtaining readings of statistical variables in a random manner, said device comprising a base member having a bottom wall, a cylindrical side wall extending vertically above said bottom wall, a vertical centering post projecting from said bottom wall centrally of said cylindrical side wall, a data carrying circular spool having a circular bottom wall centrally supported for rotation on said post, said cylindrical side wall having reference means for obtaining a reading of information from said spool, a central hub extends above a top face of said spool bottom wall to constitute a finger grasping post to impart rotation to said spool, and a post receiving cavity extending into said hub from a bottom face of said spool to receive said centering post therein, said centering post being shorter than the depth of said cavity whereby said spool will rest on an elevated concentric portion of a top surface of said bottom wall, passage means in said cylindrical side wall for the admission of air in the area bounded by said cylindrical side wall to create an air cushion under said bottom wall of said spool when rotated on said support post to liberate said spool from frictional engagement with said elevated concentric portion, said concentric portion constituting a braking surface to frictionally arrest said spun spool when lowered thereon by gravity as it decreases its rotational speed.

2. A device as claimed in claim 1 wherein said spool is provided with peripheral retention means for vertical support of a flat data strip about said spool.

3. A device as claimed in claim 2 wherein said peripheral retention means is provided by a short vertical peripheral rim about said spool and a cylindrical vertical back wall closely spaced inwardly of said rim to define a retention slot between said rim and said cylindrical vertical back wall.

4. A device as claimed in claim 3 wherein said back wall is substantially higher than said peripheral rim to provide a solid support backing surface for said data strip.

5. A device as claimed in claim 4 wherein there is further provided retention lugs projecting inwardly of said peripheral rim into said retention slot to apply clamping pressure on lower edge portions of said data strip positioned in said retention slot.

6. A device as claimed in claim 1 wherein said passage means is comprised by one or more openings in said cylindrical side wall, each said opening extending downwards from a top edge of said cylindrical side wall.

7. A device as claimed in claim 6 wherein each said opening has a bottom edge provided with a locating slot, said slot constituting said reference means.

8. A device as claimed in claim 1 wherein said top face of said spool bottom wall constitutes a support surface for a flat data disc.

* * * * *